United States Patent [19]

Boe

[11] Patent Number: 4,846,364

[45] Date of Patent: Jul. 11, 1989

[54] TRANSPORTATION CONTAINER FOR FLUID/GAS SAMPLES

[75] Inventor: Einar Boe, Notodden, Norway

[73] Assignee: Norsk Hydro a.s., Oslo, Norway

[21] Appl. No.: 159,040

[22] PCT Filed: Jun. 1, 1987

[86] PCT No.: PCT/NO87/00043

§ 371 Date: Feb. 8, 1988

§ 102(e) Date: Feb. 8, 1988

[87] PCT Pub. No.: WO87/07585

PCT Pub. Date: Dec. 17, 1987

[30] Foreign Application Priority Data

Jun. 13, 1987 [NO] Norway ..... 862367

[51] Int. Cl.[4] ..... B65D 8/04

[52] U.S. Cl. ..... 220/5 A; 138/30

[58] Field of Search ..... 220/5 A; 138/30

[56] References Cited

U.S. PATENT DOCUMENTS

| | | | |
|---|---|---|---|
| 3,587,653 | 6/1971 | Jacobellis et al. | 138/30 |
| 3,836,335 | 9/1974 | Eppes . | |
| 3,843,010 | 10/1974 | Morse et al. | 138/30 X |
| 4,129,025 | 12/1978 | Carey et al. | 138/30 X |
| 4,437,346 | 3/1984 | Kummer | 73/221 |
| 4,753,368 | 6/1988 | Lescaut | 220/5 A X |

FOREIGN PATENT DOCUMENTS

| | | |
|---|---|---|
| 109159 | 3/1968 | Denmark . |
| 2417221 | 11/1975 | Fed. Rep. of Germany . |
| 7712993-0 | 8/1980 | Sweden . |
| 2111939 | 7/1983 | United Kingdom . |

*Primary Examiner*—Donald F. Norton

*Attorney, Agent, or Firm*—Wenderoth, Lind & Ponack

[57] ABSTRACT

A bottle or container includes two semispherical parts which are fixed to each other and are equipped with valves at each end. The bottle can have an inner metal lining and a semispherical membrane which presses against the one part of the lining and has a flange welded between the two parts of the lining. The metal lining with membrane and end pieces forms a replaceable unit. By sampling, the bottle first is filled with a counter pressure medium, for example water, until the membrane lies tightly against one half of the bottle. The bottle is then filled with the fluid/gas-sample such that the membrane reverses as water is pressed out and the sample flows in. The membrane will reverse until it presses against the opposite hemisphere, and the bottle thereby is filled with fluid/gas sample.

7 Claims, 3 Drawing Sheets

TRANSPORTATION CONTAINER FOR FLUID/GAS SAMPLES

BACKGROUND OF THE INVENTION

The invention relates to a bottle or container for containing liquid/gas and especially suited for transportation of samples thereof.

Duringn oil and gas production, automatic samplers are sent down to the well for collection of samples. The samples are transferred to transportation bottles which are sent to a laboratory for analysis. Samples from oil/-gas-separators are also transferred to transportation bottles for transportation to the laboratory. Some samples are stored for many years, and these are meant to be stored in the transportation bottles under a fixed pressure.

It is very important that the bottles be clean, sterile and free of air to get representative samples. Previously, several different procedures were used to eliminate air from the bottles. The most common process is first to evacuate the bottles and then fill them up with mercury. When the oil/gas is filled into the bottle, the mercury will be replaced, and an extra bottle for collection of the mercury is necessary, since mercury is poisonous. Also, prohibition of use of mercury already has come into affect in some countries, and it is expected that use of mercury also will be forbidden in several other countries. Bottles filled with mercury are also very heavy to handle. The mercury also represents an investment.

Another method is just to evacuate the bottles by use of a vacuum pump. By this method one cannot be sure that all the air is removed from the bottle. Water has also been used to replace air in the bottles. By use of water a strange or foreign element is added to the sample. It is therefore an advantage to use water from the well where the sample was collected. This however is very bothersome.

Also known is a method where oil and gas are blown through the bottle until all air is removed and a representative sample is obtained. This is a bothersome and risky method, and it is, for example, not suited when a limited sample must be transferred.

SUMMARY OF THE INVENTION

An object of the invention thus is to develop a transportation bottle or container which does not add strange or foreign elements to the sample and at the same time makes it possible to replace the air in the bottle in an easy way. It is a further important object to provide a bottle which makes possible a quick and secure sampling of representative samples and that is safe and easy to use for those who handle the bottle.

These and other objects of the invention are obtained with the apparatus described below, and the invention is further defined and characterized in the following claims.

As main features the transportation bottle includes a body with two hemispherical inner surfaces and fixed to each other with a hemispherical membrane having a flange fixed between the two parts of the sphere. The transportation bottle can have an inner lining. Before transference of the samples to the transportation bottle the membrane is positioned tightly against the one of the inner hemispherical surfaces. The bottle is equipped with a valve in each end on opposite sides of the membrane. To fill the bottle, one valve is connected to a counter pressure medium, for example water, and first is opened, and for example water pours in and fills the bottle from the side thereof opposite the side against which the membrane is positioned. The bottle is filled with water until there is achieved a pressure large enough to ensure that the membrane is forced against the inner wall of the bottle. The valve on the water side then is closed. The bottle is then attached, for example, to an oil/gas separator, and the valve on the side leading to oil/gas is opened. This will not involve any reaction to the membrane because the pressure on the water side will resist the oil/gas pressure. Thereafter, the valve on the water side is opened, and the pressure of the oil/gas forces out the water, and the sample of oil/gas will fill the bottle as the membrane reverses round a weakened area until it is pressed toward the opposite inner wall of the bottle. When this has happened, the bottle is filled with oil/gas. Both valves will then be closed.

BRIEF DESCRIPTION OF THE DRAWINGS

Other features of the invention will be described in more detail below with reference to the accompanying drawings, wherein.

DETAILED DESCRIPTION OF THE INVENTION

Figure 1:
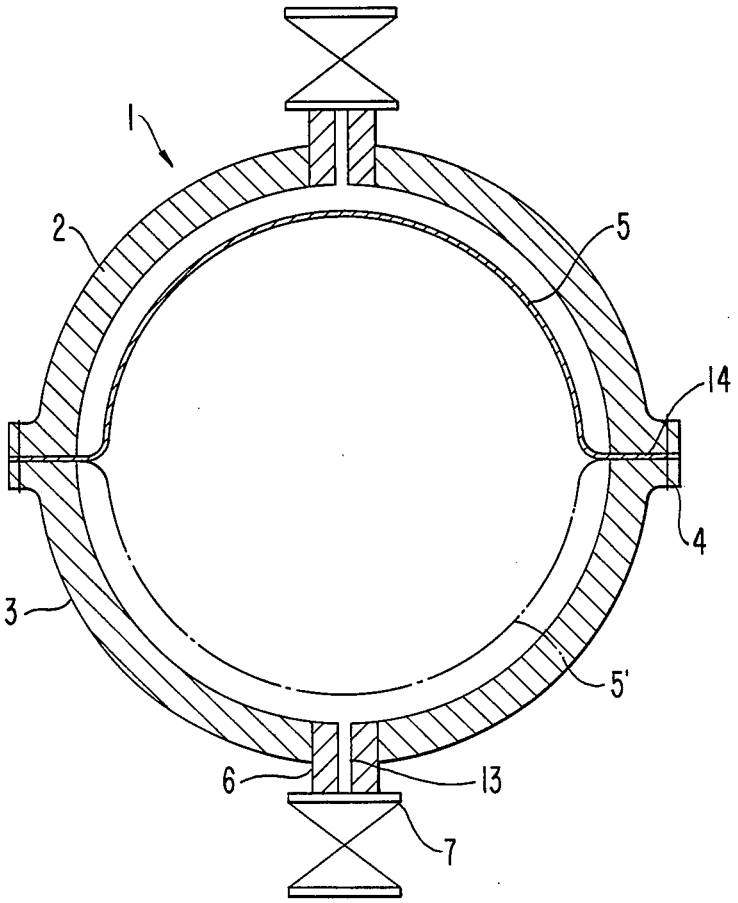
FIG. 1 is a schematic sectional view of a sample bottle according to the invention.

A bottle or container 1 shown in FIG. 1 consists of two hemispherical parts 2, 3 which can be fixed to each other. In FIG. 1 the two half parts of the bottle are equipped with respective flanges 4 such that a membrane 5 also functions as a packing 14. How the two parts of the bottle are fixed to each other is not essential as long as such fixation provides a tight connection. The dashed line 5' shows the membrane in a reversed position. Each part of the bottle is equipped with an end piece 6 with a through bore 13 and a valve 7.

The membrane can be made of different materials. For less flexible materials, as for example metals, it is important, to achieve reversing of the membrane, to have a weakened area of the membrane which is more flexible. This will function as a starting point for the reversing operation and ensure that the membrane is uniformly reversed. With more flexible materials such as for example rubber, this will not be necessary. The choice of the materials of the bottle must be adapted to the samples it shall be used for.

Figure 2:
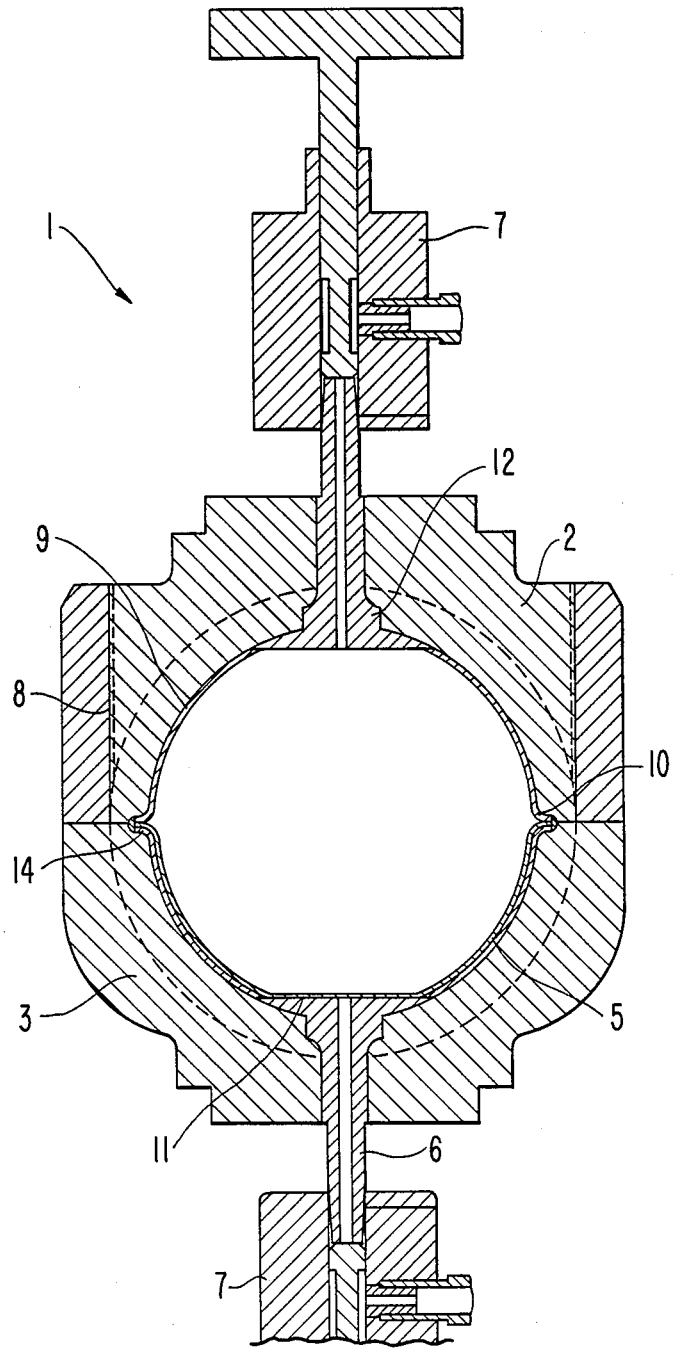
FIG. 2 is a sectional view of a sample bottle with an inner lining.

FIG. 2 shows an especially preferred design of the bottle. Here the bottle consists of a body with an inner spherical face. This design has screw threads 8 for screwing together the two halves 2, 3 of the bottle. The bottle is equipped with an inner metal lining 9. In this case the lining forms the packing and the other bottle takes up pressure forces. The materials of the outer bottle halves 2, 3 have high rigidity. A test pressure to be employed may be 1500 bar, and a working pressure 700 bar. Preferably, the lining is acid proof steel and has a thickness on the order of 1 mm. The membrane 5, which also can be made of the same material, is firmly welded between the two halves of the lining. Both the metal lining and the membrane are provided with respective small flanges 10, 14 that are welded together with the flange 14 of the membrane between the flanges 10 of the two halves of the lining. This arrangement also works as a packing between the two halves 2, 3 of the bottle.

The membrane has a thickness on the order of 0.4 mm. Membranes made of aluminum also have been tried with great success. It is important that the membrane is quite even and smooth to ensure uniform reversal thereof. For this reason the membrane has a weakened area which will cause the membrane more easily to begin to reverse uniformly under influence of pressure. In FIG. 2 the membrane is shown with a planar part 11 which forms the weakened area.

Figure 3:
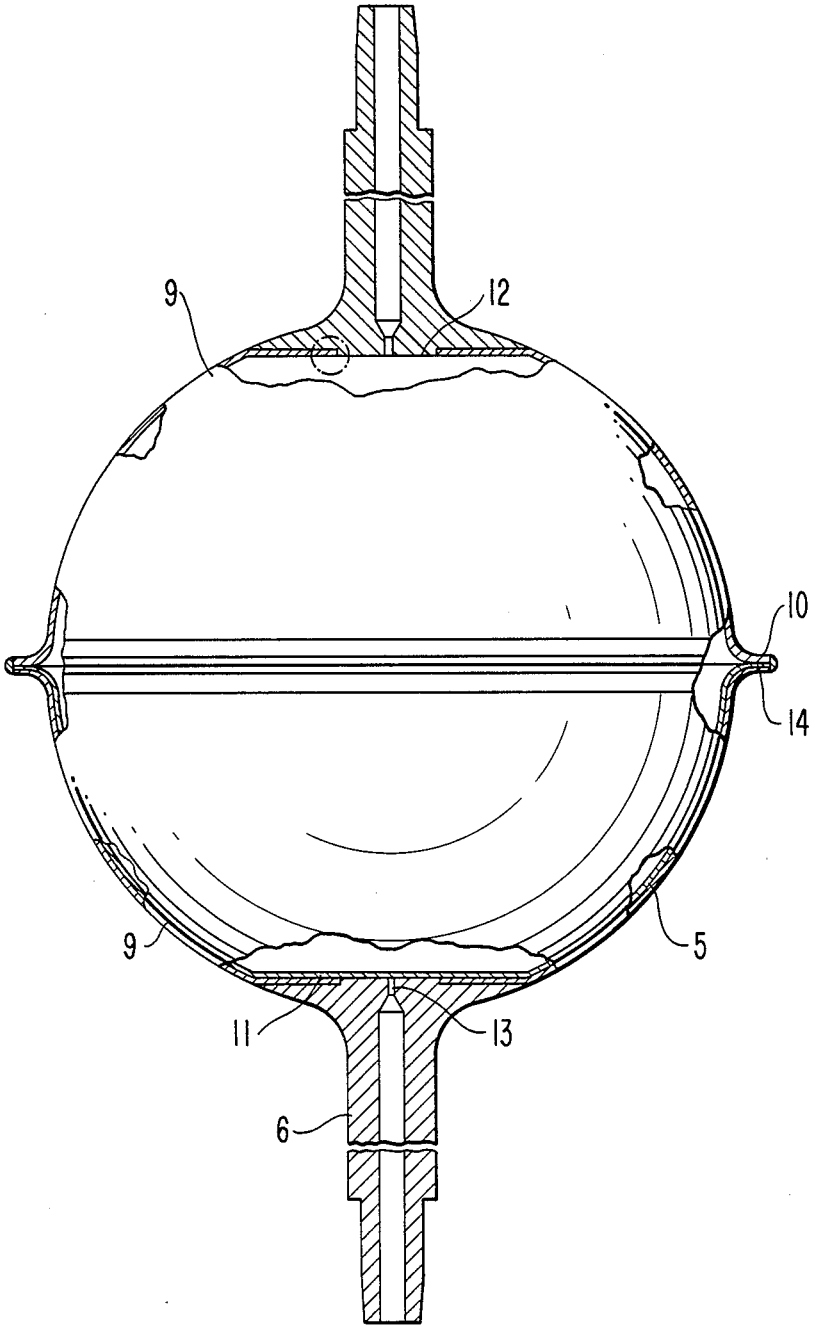
FIG. 3 is a partial sectional view of an inner lining with membrane and end pieces.

The bottle in FIGS. 2 and 3 has end pieces 6 which are welded to the inner metal lining 9 and which have through holes 13 for connection to valves 7. The end pieces and the lining form a replaceable unit. After production of the inner lining, it is tested with helium for control of tightness. When all parts of the bottle are assembled, a test with helium is again performed for control of valves/end pieces. Finally, a pressure test is performed. In FIGS. 2 and 3 the end pieces 6 are shown with planar regions 12 that come into contact with the membrane to better take up the pressure from the membrane. A lining with end pieces and a membrane as shown in FIG. 3 are meant to be used once. It has, however, been shown by experiments that the membrane can be reversed backwards and forwards several times without any indication of leakage.

The volume of the illustrated bottle is about 0.7 l, but it can be made in several sizes as required.

Before the bottle can be filled with, for example, oil/gas-samples either from a separator or from a sampler, it must be emptier of air. The bottle 1 is assembled with the membrane contacting the lining 9 in one half of the bottle in such a way that the membrane is directed toward the inner face of the respective end piece 6. The valve 7 at the opposite side is opened to supply a counter pressure medium which, as an example, can be water. Other fluids can also be used. The bottle is filled with water of known origin until there is provided a pressure large enough to ensure that the membrane is pressed against the inner wall of the container. (This condition can be determined and controlled with the help of X-ray). The valve leading to the water is then closed. The bottle is then fixed to a place for taking samples, and the other valve, i.e. the valve leading to oil/gas is opened. It is preferable to use displacement bodies in the bore 13 in the end piece on the oil/gas side to ensure as small a volume of air in the end pieces as possible. Since the bottle had been completely filled with water, the pressure of the water will resist the pressure of the oil/gas. When the valve leading to water is opened, the membrane begins to reverse as the pressure of the oil/gas entering the bottle presses the water out. The water discharged will at any time give an indication of how much of the oil/gas sample has been filled into the bottle. It is very important that the membrane have a uniform thickness and have a weakened area which will cause starting of reversal of the membrane and also a uniform reversal. With a thickness of the membrane of 0.4 mm, and in this case a diameter of 110 mm, the pressure necessary to achieve reversal is about 0.3 bar. The bottle is filled with oil/gas, and the valves are closed. The sample is now ready for transportation to a laboratory for analysis. The next time the bottle is to be used, it will be equipped with a new inner lining with end pieces and membrane which in advance are tested for tightness (tested with helium), filled with water and pressure tested.

In the drawings there are shown transportation bottles which are spherical or have an inner spherical face. These are designs which are especially preferred for high pressures. The principle of the invention, however, is also usable with lower pressures and other types of samples. Other designs of the bottle then can be employed, for example an elliptical design. If, for example, a rubber membrane is used, one is more free to choose the design of the bottle.

By this invention it is possible to provide a bottle of a construction which makes possible a rapid and secure transference of a clean sample and where the bottle also is especially suited for transportation of the sample to a laboratory for analysis. The bottle is not only suited for sampling of oil/gas samples, but is also generally useful for sampling of other fluids where clean samples are important.

I claim:

1. A sample container for the transportation and the storage over long periods of time of liquid/gas samples at high pressures, said sample bottle comprising:

a body formed of two half parts joined together to form a substantially spherical interior, each said half part having therethrough an inlet/outlet passage connected to said interior, and said interior being defined, in each said half part, by a substantially hemispherical surface and by a planar surface extending perpendicular to the respective said passage; and a reversible stiff membrane fixed at a periphery thereof between said half parts of said body and dividing said interior, said membrane being formed of a metal that is diffusion tight to the liquid/gas sample and having a uniform thickness, said membrane having a configuration complementary to the configurations of each of said half parts and defined by a substantially hemispherical portion complementary to each of said substantially hemispherical surfaces and a planar portion complementary to each of said planar surfaces, such that said membrane may be reversed within said interior between opposite positions in direct contact with respective said substantially hemispherical and planar surfaces.

2. A sample container as claimed in claim 1, further comprising a thin lining replaceably mounted within said two half parts and defining said interior.

3. A sample container as claimed in claim 2, wherein said lining is formed of two half portions defining said two substantially hemispherical surfaces, said two half portions having peripheral flanges joined together.

4. A sample container as claimed in claim 3, wherein said periphery of said membrane is joined to said peripheral flanges of said half portions of said lining.

5. A sample container as claimed in claim 4, wherein said lining is formed of metal, and said periphery of said membrane and said peripheral flanges of said half portions of said lining are welded together.

6. A sample container as claimed in claim 4, wherein said joined periphery of said membrane and said peripheral flanges of said half portions of said lining are positioned between peripheral surfaces of said two half parts of said body and form a packing therebetween.

7. A sample container as claimed in claim 3, further comprising a pair of end members fixed to respective said half portions of said lining such that said lining and said end members form a replaceable unit, each said end member extending through a respective said half part of said body, and each said end member having therethrough a respective said passage and defining a respective said planar surface.

* * * * *